United States Patent [19]

Tindall

[11] Patent Number: 4,515,190

[45] Date of Patent: May 7, 1985

[54] ICE CREAM CAN FILLING MACHINE WITH CONTENT VARIGATOR

[76] Inventor: Frank A. Tindall, 1150 East U Ave., Vicksburg, Mich. 49097

[21] Appl. No.: 496,136

[22] Filed: May 19, 1983

[51] Int. Cl.[3] ..... B65B 3/04

[52] U.S. Cl. ..... 141/131; 141/175; 141/186; 141/256; 141/281; 141/284; 141/372; 141/373; 141/392

[58] Field of Search ..... 141/131, 148, 157, 169, 141/143, 147, 150, 165, 172, 175, 178, 202, 265, 272, 281, 282, 1-12, 100-107, 392, 346-362, 369-381

[56] References Cited

U.S. PATENT DOCUMENTS

| | | | |
|---|---|---|---|
| 533,065 | 1/1895 | Hutches, Jr. | 141/265 |
| 1,713,023 | 5/1929 | Bushman et al. | 141/281 |
| 2,648,476 | 8/1953 | Kennedy, Jr. | 141/131 |
| 2,899,789 | 8/1959 | Smith | 141/105 |
| 3,064,697 | 11/1962 | Maione | 141/175 |

*Primary Examiner*—Houston S. Bell, Jr.
*Attorney, Agent, or Firm*—Austin A. Webb

[57] ABSTRACT

Pusher arrangement simultaneously push the open end of an empty container against the inclined side of a downwardly opening delivery cone and simultaneously push a preceeding filled container from below the cone. A spring supported platform below the cone supports the container being filled and lowers it as it is filled. A continuously operating source of material delivers continually to the cone. A first control actuated by the filled container reverses the pusher arrangement. The spring device supporting the container being filled are adjusted to trip the control before the container is fully filled. A second control actuated at the fully advanced position of the pusher arrangement again reverses the pushed arrangement. A first spring connected to the platform has its opposite end connected to a selectively adjustable fixed anchor. A second spring has one end connected to be moved with the extensible end of the first spring; and has its other end connected to the pusher arrangement to tension the second spring in advanced positions of the pusher arrangement.

A modified delivery cone has a cylindrical housing intersecting the cone at an angle to the axis of the cone. A tube rotatably mounted in the housing projects in sealed relation into the cone and has plural nozzles projecting in radially spaced relations into the cone. One or more conduits for delivering varigating liquid connect to the housing. The tube has one or more openings to admit the liquid for delivery to the nozzles. The tube has a partition to channel different liquids to different nozzles.

17 Claims, 8 Drawing Figures

ICE CREAM CAN FILLING MACHINE WITH CONTENT VARIGATOR

DETAILED DESCRIPTION

The drawings, of which there are four sheets, illustrate a preferred form of the filling machine and the modified form of the delivery cone with the varigator nozzles.

Figure 2:
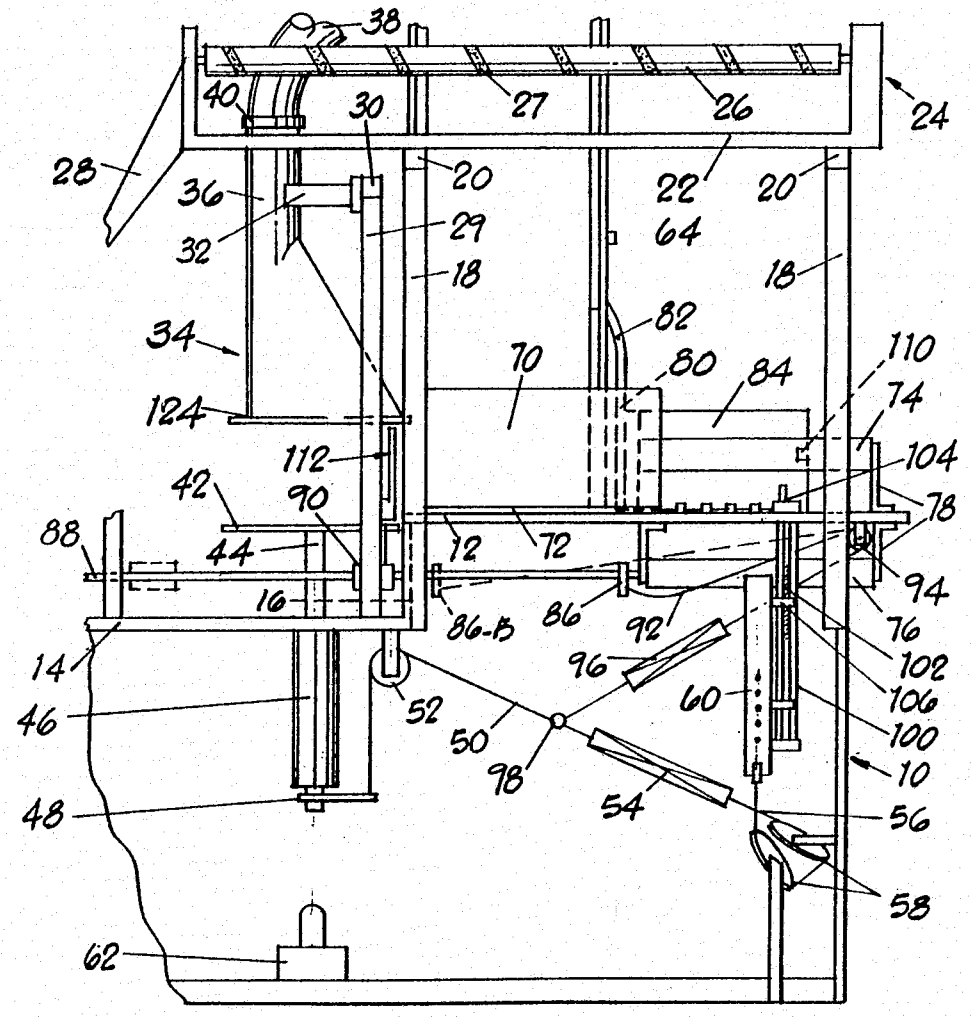
FIG. 2 is an elevational view of the delivery end of the structure shown in FIG. 1.

The machine includes a base generally indicated at 10 having a stepped top panel with an upper right panel section 12 connected to a lower left panel section 14 by a step 16. A pair of uprights 18 secured to the front side of the base at the ends of the top panel section have T-shaped cross pieces 20 which support the bottom 22 of a can cover delivery conveyor generally indicated at 24. The conveyor consists of two parallel rollers 26 with spiral friction ribs 27 which advance a row of covers edgewise to a chute 28 delivering downwardly at the left end to the covering station (not illustrated).

A pair of uprights 29 secured to the top of lower panel section 14 just to the left of the step 16 support a cross piece 30. A strut 32 projects to the left from the cross piece over the lower section 14 and is located behind the cover delivery conveyor. The strut supports a downwardly opening delivery cone generally indicated at 34. The upper end of the cone connects to a vertical supply tube 36 which is displaced toward the left of the vertical central axis of the lower end of the cone, as shown in FIG. 2. A delivery duct 38 from the ice cream freezer is coupled to the tube at 40.

Located directly under the cone 34 is a support platform 42. The platform is supported on the upper end of a slide rod 44 which extends through the lower panel section 14 and is slidably guided by an elongated bearing sleeve 46 secured to the under side of the panel. The lower end of the rod 44 carries a laterally projecting arm 48. The arm 48, the slide rod and the platform are yieldably supported by a cable 50 which is trained over a pulley 52 to a coil spring indicated conventionally at 54. The other end of the spring is connected by a cable 56 which passes around two pulleys 58 to a vertically adjustable anchor bar 60 to be described presently. The lower end of the slide rod 44 co-acts with and actuates a limit switch 62 when the pressure of the can being filled depresses the platform 42 to the lower panel section 14. It will be noted that pressure of the can is a combination of the weight of ice cream already in place in the can, plus the kinetic force of moving ice cream still being delivered to the can.

Empty cans are supplied to a can delivery chute indicated generally at 64 and consisting of angled back corner posts 66 and upright front corner posts 68 secured to the top of the upper panel section 12. The chute projects upwardly behind the cover delivery conveyor 24. Cans travel down the chute in horizontal position with their open ends to the left as viewed in FIGS. 2, 3 and 4. Cans are delivered singally along the inclined lower end of the chute onto the upper panel section 12 and against a fixed stop plate 70 having a flange 72 on its lower edge secured to the upper panel section.

Cans are advanced simultaneously to the left along the upper panel section 12 and the lower panel section 14 by fluid actuated cylinder means 74 and 76 secured to the upper and lower sides of the upper panel section by brackets 78. The piston of the upper cylinder connects to a pusher plate 80 having an upwardly projecting finger 82 with a curved upper end at its center. The rear edge of the pusher plate carries an upright stop plate 84 projecting to the right along its rear edge. When the pusher plate is advanced to the left the stop plate closes off the lower end of the can feed chute 64 until the pusher is retracted.

Figure 1:
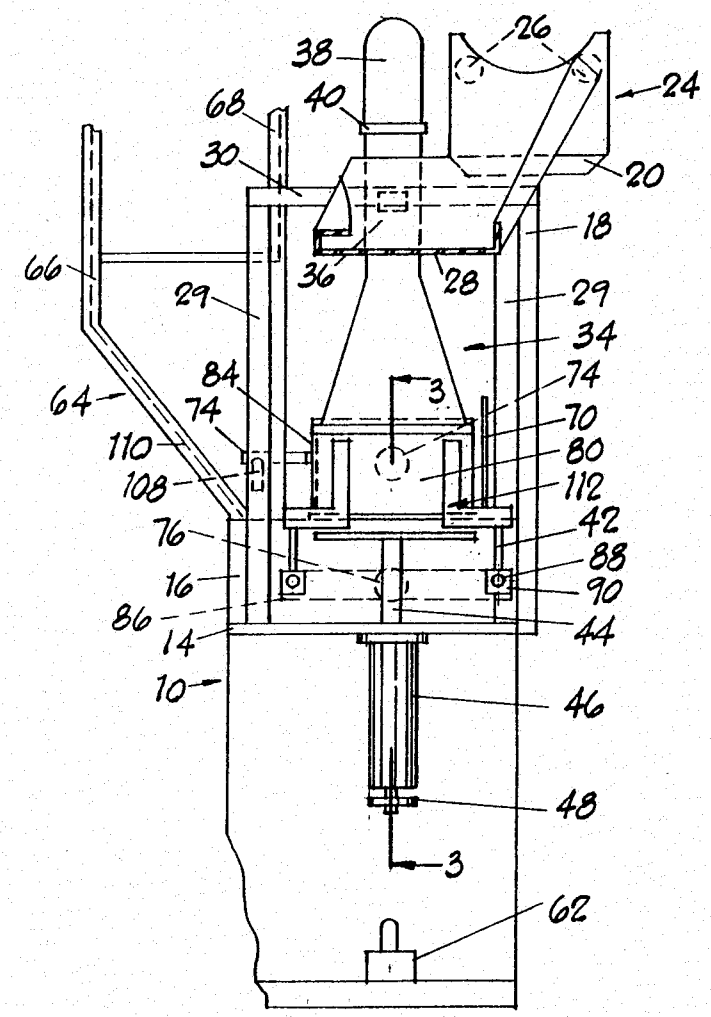
FIG. 1 is a front elevational view of the filling machine, with the can capping portion broken off.
Figure 3:
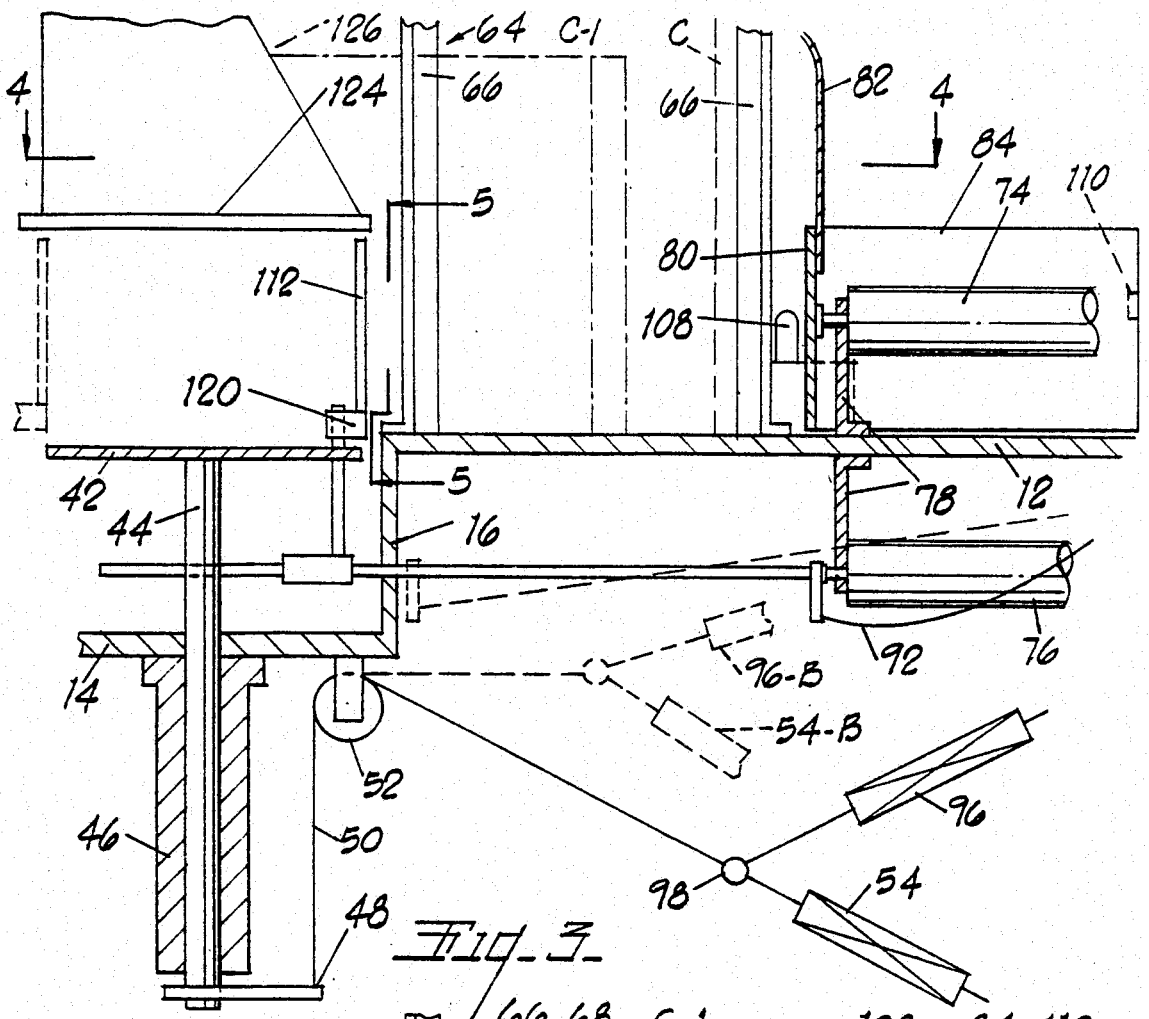
FIG. 3 is an enlarged, fragmentary, vertical cross sectional view taken along the plane of the line 3—3 in FIG. 1 and looking in the direction of the arrows.
Figure 4:
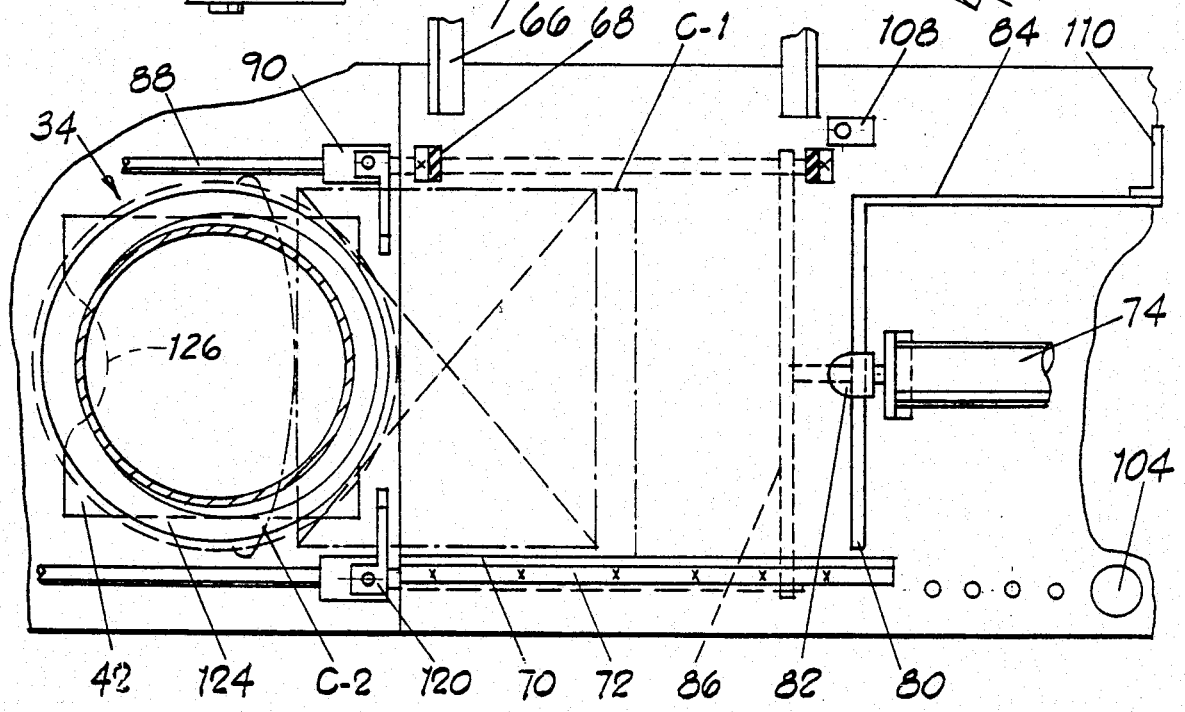
FIG. 4 is a horizontal cross sectional view taken along the plane of the line 4—4 in FIG. 3 and looking in the direction of the arrows.

The piston of the lower cylinder means 76 advances a cross head or cross bar 86 to the left in FIGS. 1 and 3. The ends of the cross bar connect to and advance front and rear can pusher rods 88 which project through the step 16 of the top panel and project to the left on each side of the support platform 42. Blocks 90 carried by the pusher rods to the left of the step 16 carry full can pushers to be described presently. A cable 92 connected to the cross bar 86 is trained over a pulley 94 to a second coil spring indicated conventionally at 96. The opposite end of spring 96 is coupled to cable 50 at 98.

Depending below the forward edge of the upper panel section 12 is a support bracket 100 for an adjusting screw 102. A hand wheel or knob 104 on the upper end of the screw serves to turn the screw. The previously described anchor bar 60 carries a traveling nut 106 engaged with the screw to raise or lower the anchor bar and thus adjust the tension in spring 54. The tension applied to spring 54 may also be adjusted by changing the point of connection of the cable 56 to the anchor bar 60. Other unnumbered controls such as on-off buttons are shown to the left of knob 104 in FIG. 2.

Positioned on the upper rear edge of the upper panel section 12 is a second limit switch 108. The switch is positioned to be engaged and actuated by a control finger 110 secured to the can blocking stop plate 84 when the pusher plate 80 is in its fully advanced position. This acts by control means (not illustrated) to reverse the travel of the pistons in each of the upper and lower cylinders 74 and 76.

Figures 5, 6:
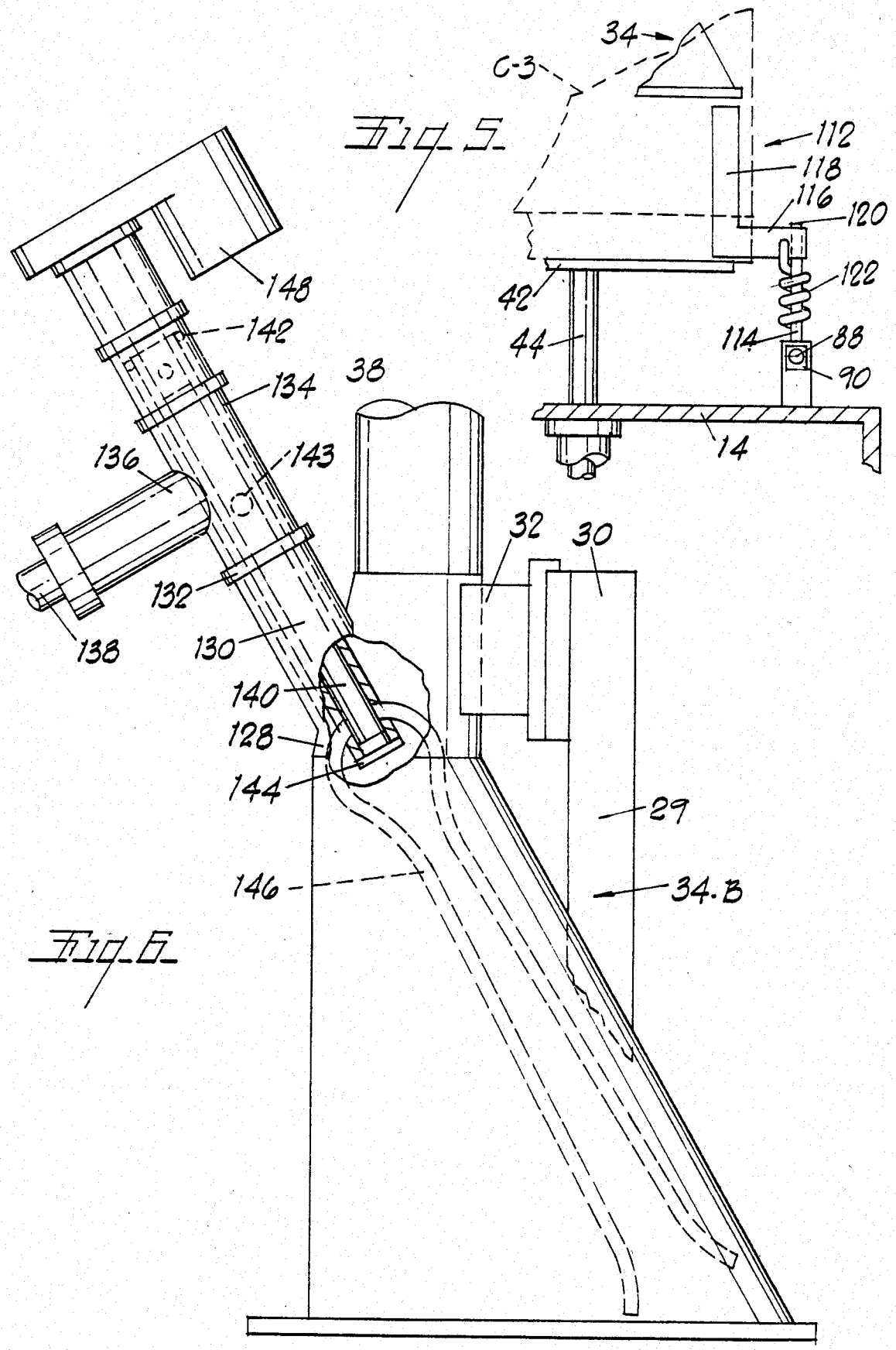
FIG. 5 is a fragmentary, further enlarged, cross sectional view taken along the plane of the broken line 5—5 in FIG. 3 and looking in the direction of the arrows.
FIG. 6 is a front elevational view of a modified delivery cone with parts broken away and in cross section to illustrate the content varigator parts of the modified cone.

As is shown more clearly in FIG. 5, the full can pushers 112 consist of upright rods 114 projecting upwardly from the pusher blocks 90. L-shaped pushers having lower horizontal arms 116 and upright arms 118 are pivoted by swivels 120 on the tops of rods 114. Coil springs 122 coiled around the rods have end lugs engaged with the rods and the arms to bias the horizontal arms to transversely extending positions to engage the rear sides of full cans on the support platform 42 but to permit retraction of the arms over incoming cans being filled as the pusher blocks are retracted by the pusher rods 88 and blocks 90.

Operation

With the machine in the full line position as shown in FIG. 3 and with a first empty can located on the upper panel section 12 and lying on its side with its open end to the left and opposed to the flange 124 on the delivery cone, the machine is turned on to activate the cylinders 74 and 76 to advance the pusher plate 80 and the full can pushers 112. This may be done by manually actuating limit switch 62 or another control. Pushers 114 idle on the initial advance but the plate 80 advances the first can, indicated by the dash lines at C, until the can reaches position C-1 shown in dot-dash lines and the lip of the leading open edge of the can strikes the inclined rearward surface of the filler cone as at 126. The support platform 42 will be raised, by tension in spring 54 and cable 50 due to the absence of a filled can. Continued advance of the pusher plate 80 causes the can to tilt upwardly and around the flange 124 on the filler cone as indicated by the double dot-dash position of the can at C-2. Final advance of the pusher plate positions the can in upright position on the support plate 42 and with the filler cone 34 projected approximately two thirds of the way down into the can as shown at C-3 in FIG. 5. At this point the machine will stand idle until the supply of frozen ice cream to duct 38 is started. The support plate and can will descend in response to the increasing pressure and weight of the contents in the can until the lower end of the support post 44 actuates the lower limit switch 62. Note that while the pressure and weight of the can actuates the switch, the spring 54 (as adjusted by the screw 102 and control 104) does not "weigh" the contents of a full can as the delivery of ice cream through the pipe 38 remains continuous and steady. The actuation of switch 62 initiates a second can feeding cycle. During the initial movement of the second can to position C-1 the lower full can pusher 112 advances into contact with the upright sides of the first can while additional ice cream is still being delivered into the first can. During the interval between movement of the cans from positions C-1 to C-3 ice cream is fed into both cans.

During the final tilting of the second can to position C-3 there is actually a portion of the lower end of the filler cone which is exposed without any can underneath it. However, there is no spillage or leakage of ice cream as the incoming mix at the lower end of the cone inherently seeks to flow in the direction of least resistance which is at the still empty space at the trailing side of the first can and into the leading side of the second can. The energy in the mass of ice cream entering from the supply tube 36 is immediately converted in a widening and slowed manner which has a force vector directed toward the widened side of the cone 34. Also the widened part of the flange 124 on the down-stream side of the delivery cone retains closure over the full can and acts as a plow to move ice cream to the trailing side of the can. (See FIG. 4).

The function of the second tension spring 96 and cable 92 is to assist spring 54 in elevating the support platform 42. It will be noted that the tension developed in spring 54 by the weight of the partially filled leading can does not increase after switch 62 is activated and is released as soon as the full can is pushed off of the platform. At this time spring 96 is pulled by cable 92 to the position shown in dotted lines at 96B so the tension in spring 96 assists in final movement of the incoming can to upright position by raising arm 48, push rod 44 and platform 42. An arcuate cut-out 126 in the down-stream edge of plate assists in quick release of the leading filled can from the support plate, but this does not decrease the tension developed in spring 96.

Modified Filler Cone With Varigator

FIG. 6 illustrates a modified form 34 B of the filler cone 34. An intermediate enlarging section 128 of the inlet tube 38 tapers outwardly on the down-stream side of the cone. This inclined portion is connected and attached to a tube or housing 130 inclined away from the tube 38. Coupled to the tube 130 by a coupling 132 is a T-coupling 134 with an inlet branch 136 projecting outwardly. A supply tube 138 for a varigating flavoring syrup (usually colored) connects to the branch. A hollow tube 140 is rotatable within the T-couplings and projects form each end thereof. Seals 142 at the ends of the T-coupling prevent escape of the syrup except through the port 143 in the hollow tube. The lower end of the rotating tube is closed by a plug 144, and curved nozzles 146 open from the inside of the tube and extend downwardly at an angle into the delivery cone proper. A motor indicated at 148 rotates the hollow tube whenever the machine is operating. It will be apparent that the outlet ends of the nozzles, rotating in a plane inclined to the axis of the cone, will distribute two spiral streams of colored flavoring into the continuously moving supply of ice cream, and these streams will be continuously varigated into ice cream entering the cans.

By maintaining constant delivery pressure of the varigating syrup, and constant pressure of the incoming ice cream as is necessary for the continuous operation of the can filling mechanism, the pattern of the varigating syrup is uniform throughout the contents of all successive cans.

Various modifications will be apparent. For example, the contour of the side of the cone on the up-stream side relative to movement of the cans may be varied if an edge or rib is provided in the path of the incoming can to start upward tilting of the can. Alternatively, the upward tilting motion may be created solely by the camming action between the open edge of the rim of the can with the periphery of the flange 124 which is located above the center axis of the incoming can at this point.

Multi-Flavor Varigation

Figures 7, 8:
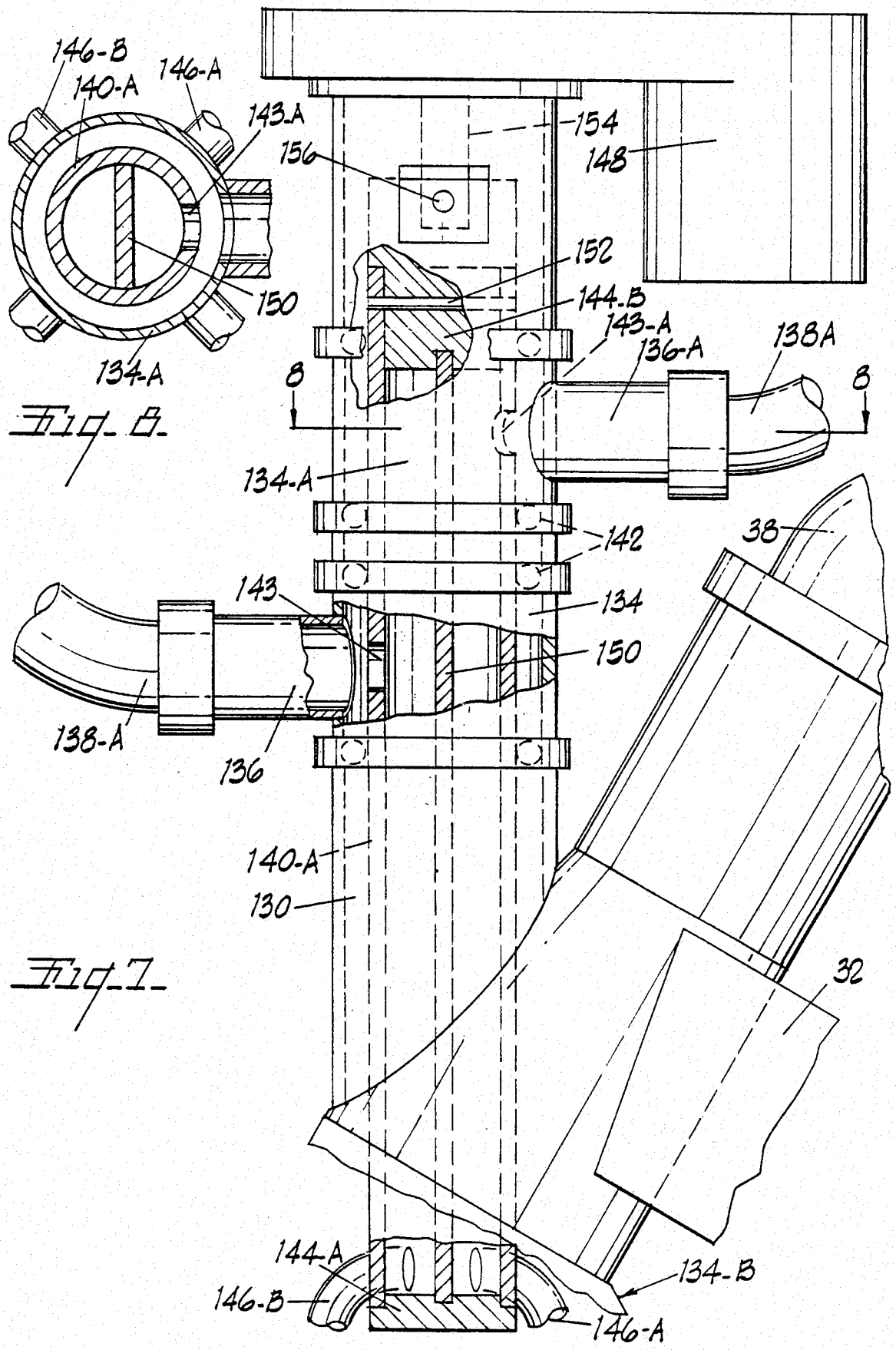
FIG. 7 is a fragmentary elevational view with parts broken away and sectioned of a modified varigator with provisions for dispensing two different syrups simultaneously.
FIG. 8 is a cross sectional view taken along the plane of the line 8—8 in FIG. 7 and looking in the direction of the arrows.

FIGS. 7 and 8 show a variation of the varigator in FIG. 6. The delivery cone 34-B and branch tube 130 remain essentially the same, but a second T-coupling 134A is added in series with the original coupling 134. This provides a second inlet branch 136-A and supply tube 138-A for a second source of varigating syrup. The syrup sources may supply the same syrup but will normally provide different flavors (and colors).

Extending through the two T-coupling is a modified hollow tube 140-A with a second port 143-A spaced axially from the first port 143 and located on the opposite side of the tube from the first port. An elongated divider plate or partition 150 extends axially and diametrically through tube 140-A. It is removably held in place at its ends by notches in the end closure plugs 144A and 144B. Plug 144-B is removably held in place by a cross pin 152. Four curved nozzles 146-A and 146-B open from the lower end of tube 140-A and extend into the delivery cone 34-B. It will be noted that the pair of nozzles 146-A open into the tube on the opposite side of the partition 150 from nozzles 146-B. Nozzles 146-A are thus fed from coupling 134-A while nozzles 146-B are fed from the lower T-coupling 134.

Plug 144-B at the top of tube 140-A is drivingly coupled to the drive shaft 154 of the motor gearing by the pin 156.

What is claimed to be new and what is desired to be secured by Letters Patent is defined in the following claims:

1. In combination with a contineously operating source of fluid ice cream, a downwardly enlarged and opening delivery cone connected at its upper end to the lower end of said source, means for successively delivering empty cans on their sides with the open ends of the cans facing the lower end of the cone, first pusher means arranged to push each can endwise against the side of said cone, a vertically movable platform disposed in its uppermost position to receive bottom of the can under said cone, support means for said platform guiding its movement to a lower position with the can thereon flush with the bottom of said cone, adjustable spring means biasing said support means to its upper position, second pusher means arranged to push filled cans off of said platform, fluid pressure operated means connected to simultaneously advance and retract said first and second pusher means, a first control element actuated by movement of said platform to lowered position and connected to activate said pressure operated means to advance said pusher means, and a second control means positioned to be actuated by movement of said pusher means to the limit of their advancing motion and connected to reverse the pressure operated means.

2. The combination as defined in claim 1 in which said second pusher means comprises:

transversely spaced parallel push rods extending in spaced relation from the front and rear side of said platform, upright posts carried by said push rods and reciprocable therewith full can pushers pivoted about said posts and projecting horizontally over the surface of said platform, and stop means co-acting between said full can pushers and said posts, to hold the projecting portions of the pushers transverse to the path of advancing motion thereof while permitting said projecting portions to swing parallel to said push on the retracting stroke.

3. The combination as defined in claim 2 in which said stop means comprise:

springs anchored at one end to said posts and having other springable ends anchored to said full can pushers.

4. The combination as defined in claim 3 in which said full can pushers are L-shaped with uprights projecting upwardly above said posts and lower arms swingable over the surface of said platform.

5. The combination as defined in claim 1 in which there is a first spring means having one end anchored relative to said cone and having its opposite end connected to be deflected by downward motion of said platform.

6. The combination as defined in claim 5 in which said one end of said first spring is adjustable relative to said cone to change the load required on said platform to actuate said first control element.

7. The combination as defined in claim 5 in which there is a second spring means having one end connected for movement with said first pusher means and its other end connected to said platform whereby lowering motion of said platform under the weight of a filled can and advancing motion of said first pusher means both load the second spring means and the second spring means accelerates return of the platform to elevated position upon removal of the filled can.

8. The combination as defined in claim 7 in which said first spring means comprises a coiled tension spring with cables at each end trained around pulleys to the end adjustable relative to said cone and to the support means for said platform, an said second spring means comprises a second coiled tension spring having one end connected to said second pusher means by a cable passed around a pulley and with its other end connected by a cable to the cable between said first spring means and said support for said platform.

9. A machine for filling cans with ice cream comprising a continuously operating and downwardly directed source, a cone-like delivery element connected at its upper end to said source and opening downwardly therebelow, flange means connected around the bottom of said cone-like element and having a periphery projecting horizontally beyond one side of the lower end of said cone-like element, said flange means being sized to fit slidably into cans to be filled, means for delivering cans successively to be filled to the side of said delivery element with the plane of the open end of the can at an angle to the plane of said flange means, whereby the edge of the flange means enters the end of the can and cams the can to upright position with the delivery element nested within the can, a vertically movable support positioned to receive the bottom of the can when nested around said flange means, an adjustable spring means connected to lower said movable support in response to increase in the weight of the can being filled and the force of material entering the can, and a control element arranged to actuated by movement of the can to below the level of said flange means, said control element being connected to initiate successive operation of said means for delivering empty cans.

10. A machine for filling cans as defined in claim 9 in which the center of the lower end of said cone-like element is off-set horizontally from the center of said source, with the projecting side of said flange means on the side opposite from the off-set.

11. A machine for filling cans with ice cream from a continuously operating source comprising, a downwardly enlarging cone-like delivery element connected to said source and arranged to have empty cans positioned therebelow, a hollow tubular housing connected to the side of said delivery element at an angle to the axis of the element, a continuously operating source of varigating syrup connected to deliver into said tubular housing, a rotatable part rotatable in said housing and sealed to the ends thereof, a delivery nozzle carried by said rotatable part and projecting into said delivery element in radially spaced relation to the axis of rotation of the part, one end of said nozzle communicating with the space between said rotatable part and said housing, and means connected to rotate said rotatable part.

12. A machine for filling cans as defined in claim 11 in which said rotatable part is a hollow tube communicating with the inside of said housing, and in which there are two angularly spaced nozzles opening from within the tube at spaced points with said cone-like delivery element.

13. A machine for filling cans with ice cream as defined in claim 9 in which there is a hollow tubular housing connected to the side of said delivery element at an angle to the axis of the element, a continuously operating source of varigating syrup connected to deliver into said tubular housing, a rotatable part rotatable in said housing and sealed to the ends thereof, a delivery nozzle carried by said rotatable part and projecting into said delivery element in radially spaced relation to the axis of rotation of the part, one end of said nozzle communicating with the space between said rotatable part and said housing, and means connected to rotate said rotatable part.

14. A machine for filling cans with ice cream as defined in claim 1 in which there is a hollow tubular housing connected to the side of said delivery element at an angle to the axis of the element, a continuously operating source of varigating syrup connected to deliver into said tubular housing, a rotatable part rotatable in said housing and sealed to the ends thereof, a delivery nozzle carried by said rotatable part and projecting into said delivery element in radially spaced relation to the axis of the rotation of the part, one end of said nozzle communicating with the space between said rotatable part and said housing, and means connected to rotate said rotatable part.

15. A machine for filling cans as described in claim 12 in which there is a partition extending diametrically and axially from end to end of said hollow tube and between said two nozzles, a second source of varigating syrup connected to said tubular housing in axially spaced relation to the first mentioned source of syrup and connected to deliver into said tubular housing on the opposite side of said partition from the first source of syrup.

and annular seal means located between the inside of said tubular housing and the outside of said rotatable hollow tube.

16. A machine for filling cans as defined in claim 14 in which there is a partition extending diametrically and axially from end to end of said hollow tube and between said two nozzles, a second source of varigating syrup connected to said tubular housing in axially spaced relation to the first mentioned source of syrup and connected to deliver into said tubular housing on the opposite side of said partition from the first source of syrup, an annular seal means located between the inside of said tubular housing and the outside of said rotatable hollow tube.

17. A machine for filling ice cream cans with ice cream from a continuously operative source comprising:

a downwardly enlarging cone-like delivery duct connected to said source and having an outlet end smaller than the open end of said cans, reciprocable means for advancing empty cans successively toward said outlet end with the top to bottom axis of the cans extending below said outlet end and the open end of the can facing said duct, a vertically reciprocable and horizontal support located below said outlet end, said duct having an exterior edge engagable within the open end of each can whereby advancing motion of the can tilts the can to upright position on said support, adjustable spring means biasing said support to a raised position below the advancing lower edge of said can, first control means actuated by movement of said support to a lowered position with the upper end of the can below the level of said outlet end and connected to reverse said reciporcable means to retracted position, pusher means drivingly connected to said reciprocable means and movable therewith across the lowered position of said support to push the filled can from under said outlet end, and second control means actuated by movement of said reciprocable means to advanced position and connected to reverse movement of said reciprocable means toward retracted position.

* * * * *